US009704376B2

(12) United States Patent
Eyring et al.

(10) Patent No.: US 9,704,376 B2
(45) Date of Patent: Jul. 11, 2017

(54) SMART STAY DAY

(71) Applicant: Vivint, Inc., Provo, UT (US)

(72) Inventors: Matthew J. Eyring, Provo, UT (US); Jeremy B. Warren, Draper, UT (US); James E. Nye, Alpine, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 14/748,991

(22) Filed: Jun. 24, 2015

(65) Prior Publication Data

US 2016/0379471 A1 Dec. 29, 2016

(51) Int. Cl.
*G08B 25/00* (2006.01)
*G08B 25/08* (2006.01)

(52) U.S. Cl.
CPC ..... *G08B 25/008* (2013.01); *G08B 25/08* (2013.01)

(58) Field of Classification Search
CPC ..... G08B 25/008; G08B 25/08
See application file for complete search history.

(56) References Cited

U.S. PATENT DOCUMENTS

| | | | | |
|---|---|---|---|---|
| 5,966,432 | A | 10/1999 | Buckler et al. | |
| 6,703,930 | B2 | 3/2004 | Skinner | |
| 8,872,915 | B1 | 10/2014 | Scalisi et al. | |
| 2002/0046299 | A1 | 4/2002 | Lefeber et al. | |
| 2005/0128067 | A1 | 6/2005 | Zakrewski | |
| 2006/0181408 | A1* | 8/2006 | Martin | G08B 13/00 340/528 |
| 2008/0077685 | A1 | 3/2008 | Nguyen et al. | |
| 2014/0266669 | A1* | 9/2014 | Fadell | G05B 19/042 340/501 |
| 2014/0309789 | A1 | 10/2014 | Ricci | |
| 2015/0156031 | A1 | 6/2015 | Fadell et al. | |
| 2016/0247370 | A1* | 8/2016 | Lamb | G08B 13/08 |

FOREIGN PATENT DOCUMENTS

KR 1020120059860 A 6/2012

OTHER PUBLICATIONS

Taleb et al., Call-handling by an ims—hnb based interactive edoorbell, Wireless Communications and Networking Conference, Apr. 2010. Abstract only.

PCT International Search Report for International Application No. PCT/US2016/036212, mailed Sep. 19, 2016.

* cited by examiner

*Primary Examiner* — Leon Flores
(74) *Attorney, Agent, or Firm* — Holland & Hart LLP

(57) ABSTRACT

In some embodiments, security and/or automation systems, collectively referred to as automation systems, may offer a user the peace of mind of having an automation system active while the user is present in a residence. False alarms may become costly to both the user of the automation system and to emergency responders using resources to respond to the false alarms. The automation system may provide the benefit of an armed automation system without the risk of frequent false alarms. An automation system may provide additional or alternative security to a residence when a person is detected in the home with a reduction in the false alarms that may be present in a strict alarm state. This may provide security to a person in the home during the day and provide unique daytime features.

19 Claims, 8 Drawing Sheets

SMART STAY DAY

BACKGROUND

The present disclosure, for example, relates to security and/or automation systems, and more particularly to security features while an occupant is in a residence without triggering false alarms.

Security and automation systems are widely deployed to provide various types of communication and functional features such as monitoring, communication, notification, and/or others. These systems may be capable of supporting communication with a user through a communication connection or a system management action.

People use security and automations systems to feel safe but sometimes the systems can trigger false alarms. A user may have forgotten to disarm a portion of the system, or a portion of the system may have a single security setting which may result in false alarms if a user forgot to bypass features of the system. This may cause the user additional cost and trouble if the system continues to trigger false alarms causing a security response.

SUMMARY

In some embodiments, security and/or automation systems, collectively referred to as automation systems, may offer a user the peace of mind of having an automation system active while the user is present in a residence. False alarms may become costly to both the user of the automation system and to emergency responders using resources to respond to the false alarms. The automation system may provide the benefit of an armed automation system without the risk of frequent false alarms. An automation system may provide additional or alternative security to a residence when a person is detected in the home with a reduction in the false alarms that may be present in a strict alarm state. This may provide security to a person in the home during the day and provide unique daytime features.

In one embodiment, a method for security and/or automation systems is described. The method may comprise detecting the presence of a first person in a residence and activating a first state of the automation system based at least in part on the detecting. The method may further include dynamically adjusting an alarm threshold associated with a barrier to an entry of the residence based at least in part on the activating.

In some instances, the method may include identifying the first person. The method may further include tracking one or more actions of the identified person. The method may further include predicting an action of the first person based at least in part on the tracking. Dynamically adjusting an alarm threshold may further comprise detecting when a barrier to an entry to the residence is opened from the exterior of the residence. Dynamically adjusting an alarm threshold may further comprise alerting the first person of the detecting.

In one instance, the method may include automatically disarming an alarm based on a predetermined habitual pattern of the first person. Dynamically adjusting an alarm threshold may further comprise dynamically adjusting a doorbell parameter. The method may include detecting when a second person is proximate an entry to the residence. The method may include alerting the first person of the detecting.

In some instances, the method may include providing a visual of the second person proximate the entry to the residence to the first person. The method may include enabling the first person to silence a doorbell. The method may include determining an identity of the second person proximate the entry to the residence. The method may include routing the doorbell notification to a user of the automation system associated with the identity of the second person. Modifying alert thresholds may further comprise deactivating one or more motion sensors proximate an interior of the residence.

In one instance, the method may include activating one or more external lights to the residence based at least in part on the time of day and occupancy. Modifying alert thresholds may further comprise identifying when the first person has exited the residence. Modifying alert thresholds may further comprise deactivating an alert when the first person reenters the residence within a predetermined time threshold. The method may include identifying when a vehicle enters a driveway of the residence. The method may include alerting the first person of the vehicle.

In another embodiment, an apparatus for security and/or automation systems is described. The apparatus may include a processor, memory in electronic communication with the processor, and instructions stored in the memory. The instructions may be executable by the processor to detect the presence of a first person in a residence, activate a first state of the automation system based at least in part on the detecting, and dynamically adjust an alarm threshold associated with a barrier to an entry of the residence based at least in part on the activating.

In another embodiment, a non-transitory computer-readable medium storing computer-executable code is described. The code may be executable by a processor to detect when a second person is proximate an entry to the residence, and alert the first person of the detecting.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

In some embodiments, security and/or automation systems, collectively referred to as automation systems, may allow a user to activate security settings of an automation system when a user is present in a residence while reducing false alarms. False alarms may result in a waste of resources as emergency personnel may unnecessarily respond to a false alarm. An automation system may provide additional or alternative security to a residence when a person is detected in the home with a reduction in the false alarms that may be present in an away alarm state. This may result in security for a user at home in a residence while attempting to prevent false alarms that may result in wasted resources and unnecessary alerts. Additionally, in some embodiments, a security setting while a user is at home may offer additional security alerts based on the presence of an occupant in the home.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

Figure 1:
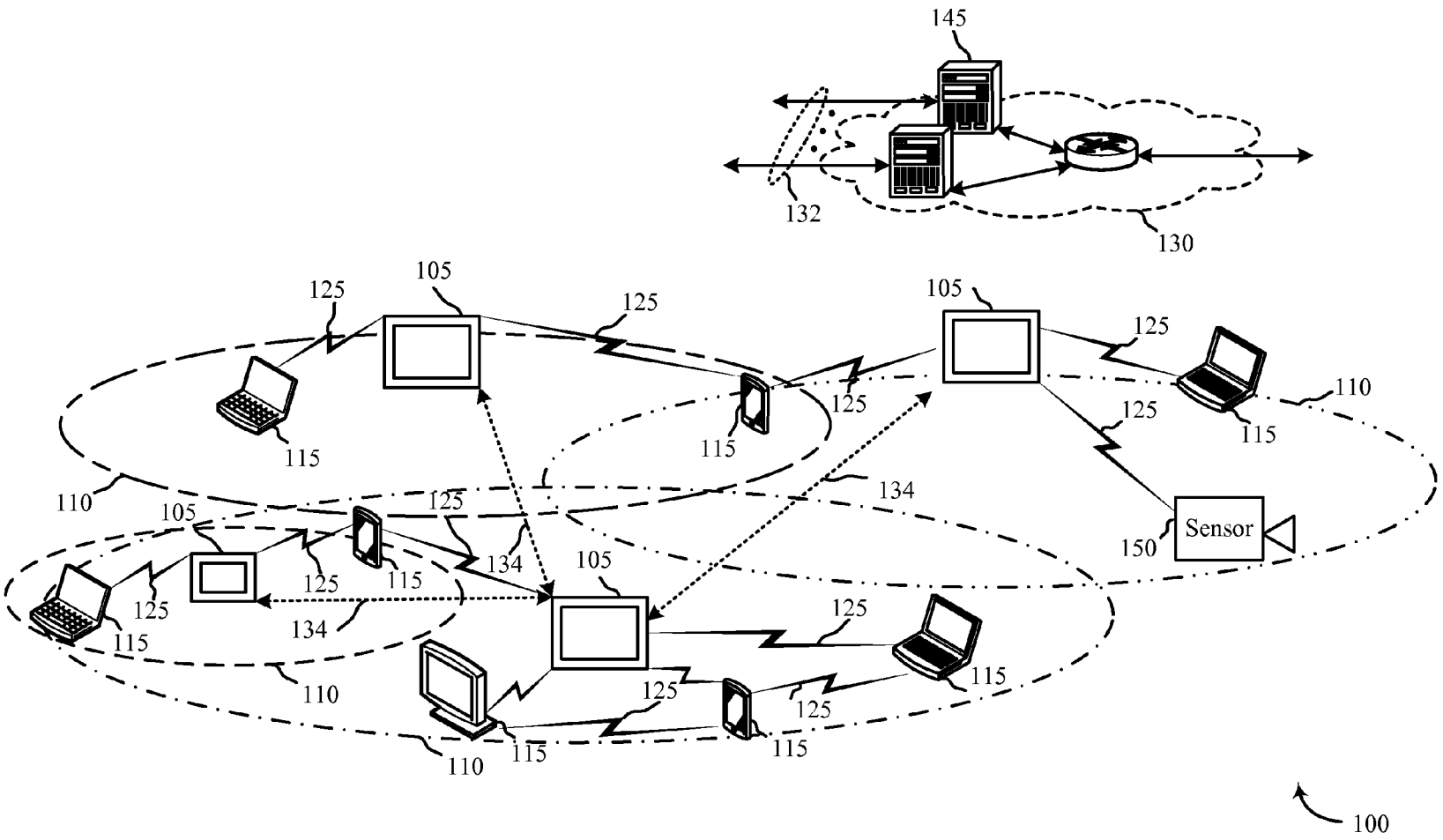
FIG. 1 shows a block diagram relating to a security and/or an automation system, in accordance with various aspects of this disclosure.

FIG. 1 illustrates an example of a communications system 100 in accordance with various aspects of the disclosure. The communications system 100 may include control panels 105, devices 115, a network 130, and/or sensors 150. The network 130 may provide user authentication, encryption, access authorization, tracking, Internet Protocol (IP) connectivity, and other access, calculation, modification, and/or functions. The control panels 105 may interface with the network 130 through a first set of wired and/or wireless communication links 132 to communicate with one or more remote servers 145. The control panels 105 may perform communication configuration, adjustment, and/or scheduling for communication with the devices 115, or may operate under the control of a controller. In various examples, the control panels 105 may communicate—either directly, or indirectly (e.g., through network 130)—with each other over a second set of wired and/or wireless communication links 134. Control panels 105 may communicate with a back end server (such as the remote servers 145)—directly and/or indirectly—using the first set of one or more communication links 132.

The control panels 105 may wirelessly communicate with the devices 115 via one or more antennas. Each of the control panels 105 may provide communication coverage for a respective geographic coverage area 110. In some examples, control panels 105 may be referred to as a control device, a base transceiver station, a radio base station, an access point, a radio transceiver, or some other suitable terminology. The geographic coverage area 110 for a control panel 105 may be divided into sectors making up only a portion of the coverage area. The communications system 100 may include control panels 105 of different types. There may be overlapping geographic coverage areas 110 for one or more different parameters, including different technologies, features, subscriber preferences, hardware, software, technology, and/or methods. For example, each control panel 105 may be related to one or more discrete structures (e.g., a home, a business) and each of the one more discrete structures may be related to one or more discrete areas. In other examples, multiple control panels 105 may be related to the same one or more discrete structures (e.g., multiple control panels relating to a home and/or a business complex).

The devices 115 may be dispersed throughout the communications system 100 and each device 115 may be stationary and/or mobile. A device 115 may include a cellular phone, a personal digital assistant (PDA), a wireless modem, a wireless communication device, a handheld device, a tablet computer, a laptop computer, a cordless phone, a wireless local loop (WLL) station, a display device (e.g., TVs, computer monitors, etc.), a printer, a camera, and/or the like. A device 115 may also include or be referred to by those skilled in the art as a user device, a smartphone, a BLUETOOTH® device, a Wi-Fi device, a mobile station, a subscriber station, a mobile unit, a subscriber unit, a wireless unit, a remote unit, a mobile device, a wireless device, a wireless communications device, a remote device, an access terminal, a mobile terminal, a wireless terminal, a remote terminal, a handset, a user agent, a mobile client, a client, and/or some other suitable terminology.

The control panels 105 may wirelessly communicate with the sensors 150 via one or more antennas. The sensors 150 may be dispersed throughout the communications system 100 and each sensor 150 may be stationary and/or mobile. A sensor 150 may include and/or be one or more sensors that sense: proximity, motion, temperatures, humidity, sound level, smoke, structural features (e.g., glass breaking, window position, door position), time, light geo-location data of a user and/or a device, distance, biometrics, weight, speed, height, size, preferences, light, darkness, weather, time, system performance, and/or other inputs that relate to a security and/or an automation system. A device 115 and/or a sensor 150 may be able to communicate through one or more wired and/or wireless connections with various components such as control panels, base stations, and/or network equipment (e.g., servers, wireless communication points, etc.) and/or the like.

The communication links 125 shown in communications system 100 may include uplink (UL) transmissions from a device 115 to a control panel 105, and/or downlink (DL)

transmissions, from a control panel 105 to a device 115. The downlink transmissions may also be called forward link transmissions while the uplink transmissions may also be called reverse link transmissions. Each communication link 125 may include one or more carriers, where each carrier may be a signal made up of multiple sub-carriers (e.g., waveform signals of different frequencies) modulated according to the various radio technologies. Each modulated signal may be sent on a different sub-carrier and may carry control information (e.g., reference signals, control channels, etc.), overhead information, user data, etc. The communication links 125 may transmit bidirectional communications and/or unidirectional communications. Communication links 125 may include one or more connections, including but not limited to, 345 MHz, Wi-Fi, BLUETOOTH®, BLUETOOTH® Low Energy, cellular, Z-WAVE®, 802.11, peer-to-peer, LAN, WLAN, Ethernet, fire wire, fiber optic, and/or other connection types related to security and/or automation systems.

In some embodiments, of communications system 100, control panels 105 and/or devices 115 may include one or more antennas for employing antenna diversity schemes to improve communication quality and reliability between control panels 105 and devices 115. Additionally or alternatively, control panels 105 and/or devices 115 may employ multiple-input, multiple-output (MIMO) techniques that may take advantage of multi-path, mesh-type environments to transmit multiple spatial layers carrying the same or different coded data.

While the devices 115 may communicate with each other through the control panel 105 using communication links 125, each device 115 may also communicate directly with one or more other devices via one or more direct communication links 134. Two or more devices 115 may communicate via a direct communication link 134 when both devices 115 are in the geographic coverage area 110 or when one or neither devices 115 is within the geographic coverage area 110. Examples of direct communication links 134 may include Wi-Fi Direct, BLUETOOTH®, wired, and/or, and other P2P group connections. The devices 115 in these examples may communicate according to the WLAN radio and baseband protocol including physical and MAC layers from IEEE 802.11, and its various versions including, but not limited to, 802.11b, 802.11g, 802.11a, 802.11n, 802.11ac, 802.11ad, 802.11ah, etc. In other implementations, other peer-to-peer connections and/or ad hoc networks may be implemented within communications system 100.

The control panel 105 and/or the remote server 145 may control alert settings based at least in part one or more settings of the automation system. For example, the sensors 150 may continue to gather information and transmit information to the control panel 105 and/or the remote server 145. The control panel 105 and/or the remote server 145 may alter one or more alert thresholds based on a setting of the automation system. For example, if a security system is set to "Alarmed-Home" certain alerts may be deactivated, certain alerts may be modified, and, in some instances, new alerts may be generated. The security system may additionally adjust the alarm thresholds based upon the "Alarmed-Home" setting. The adjustment may be related to a specific occupant or in general to an occupant being present in the residence. The control panel 105 may detect habitual patterns of an occupant to detect when certain alerts and/or alarms may be deactivated by predicting which action the occupant may take.

Figure 2:
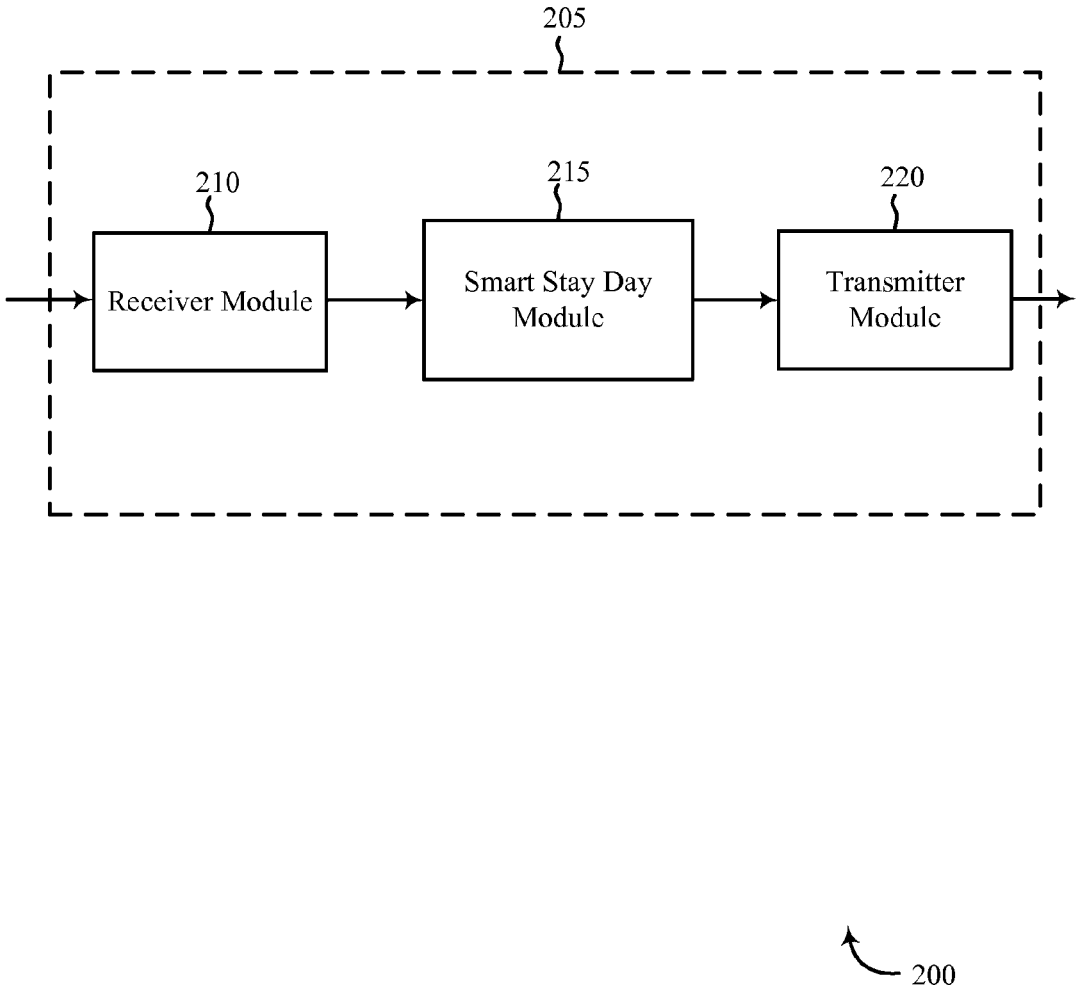
FIG. 2 shows a block diagram of a device relating to a security and/or an automation system, in accordance with various aspects of this disclosure.

FIG. 2 shows a block diagram 200 of a control panel 205 for use in electronic communication, in accordance with various aspects of this disclosure. The control panel 205 may be an example of one or more aspects of a control panel 105 described with reference to FIG. 1. The control panel 205 may include a receiver module 210, a smart stay day module 215, and/or a transmitter module 220. The control panel 205 may also be or include a processor. Each of these modules may be in communication with each other—directly and/or indirectly.

The components of the control panel 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver module 210 may receive information such as packets, user data, and/or control information associated with various information channels (e.g., control channels, data channels, etc.). The receiver module 210 may be configured to receive alert-based information from one or more sensors, security state setting information, and the like. Information may be passed on to the smart stay day module 215, and to other components of the control panel 205.

The smart stay day module 215 may control one or more alerts based on one or more settings of the automation system. The smart stay day module 215 may provide the benefit of a security system while an occupant is present in a residence while reducing the risk of false alarms. The smart stay day module 215 may detect when an entry to a residence, such as a door, window, or the like, has been opened from the inside and can alert the occupant of this occurrence. In some embodiments, if the occupant has not effectuated the opening, the automation system may issue an alarm. In other embodiments, if the occupant has effectuated the opening, the occupant may silence or deactivate an alarm. The smart stay day module 215 may track the activities of an occupant to detect behaviors and predict when actions may be taken. This may enable the smart day module 215 to effectively deactivate alarms and alerts prior to the action being taken, allowing an occupant to navigate a secure home seamlessly.

The smart stay day module 215 may screen visitors before a doorbell rings to allow the occupant security and privacy in the residence. In some instances, the occupant may have the option to silence a doorbell or to route the doorbell notification to another user. The smart stay day module 215 may proactively alert the occupant of events such as an automobile or vehicle pulling into a driveway or a person approaching a house. If more than one occupant is present, the smart stay day module 215 may alert a primary occupant when at least one occupant has exited the residence. For example, a parent may receive an alert that a child has left the residence. The alert may be different or more urgent if the child has exited a front door versus a back door. The parent may set these types of alerts to personalize their automation system experience.

The smart stay day module 215 may track the inner workings of the residence and provide alerts to a user of such events without sounding alarms. For example, the smart stay day module 215 may detect when there is motion inside a home away from an occupant, when features of the home activate such as a television, toilet, shower, and the like. The smart stay day module 215 may detect when doors open and from where they opened. For example, the smart stay day module 215 may detect when the door is opened from the inside or outside, when a door has been unlocked from the inside or outside, when a user has arrived at the residence, or when a guest has arrived at the residence. For example, the smart stay day module 215 may have one or more sensors and/or cameras proximate an outside of the home and may detect when a person is approaching the door.

The transmitter module 220 may transmit the one or more signals received from other components of the control panel 205. The transmitter module 220 may transmit one or more alerts to a user, silence one or more alarms, and the like. In some examples, the transmitter module 220 may be collocated with the receiver module 210 in a transceiver module.

Figure 3:
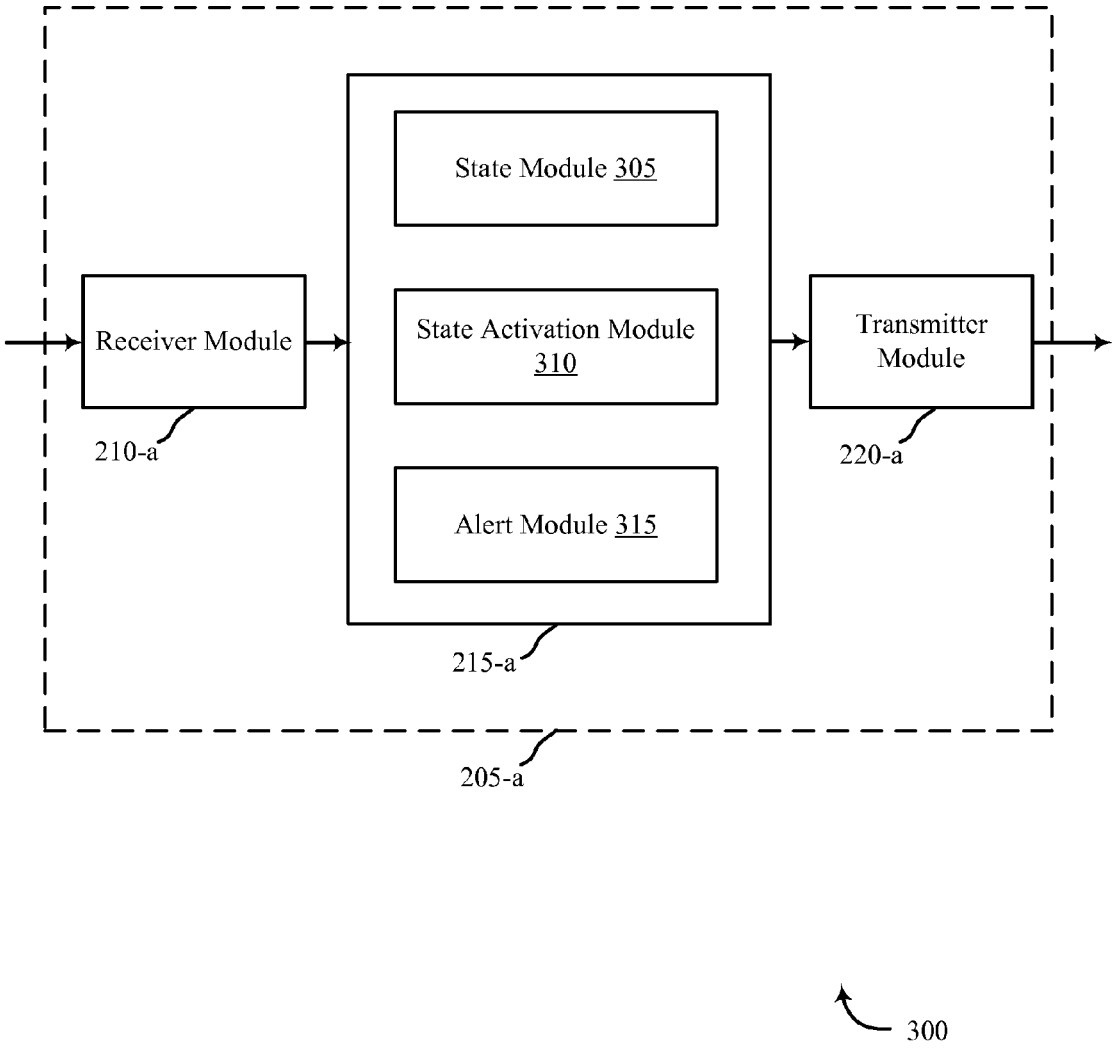
FIG. 3 shows a block diagram of a device relating to a security and/or an automation system, in accordance with various aspects of this disclosure.

FIG. 3 shows a block diagram 300 of a control panel 205-*a* for use in wireless communication, in accordance with various examples. The control panel 205-*a* may be an example of one or more aspects of a control panel 105 described with reference to FIGS. 1 and/or 2. It may also be an example of a control panel 205 described with reference to FIG. 2. The control panel 205-*a* may include a receiver module 210-*a*, a smart stay day module 215-*a*, and/or a transmitter module 220-*a*, which may be examples of the corresponding modules of control panel 205. The control panel 205-*a* may also include a processor. Each of these components may be in communication with each other. The smart stay day module 215-*a* may include a state module 305, a state activation module 310, and an alert module 315. The receiver module 210-*a* and the transmitter module 220-*a* may perform the functions of the receiver module 210 and the transmitter module 220, of FIG. 2, respectively.

The components of the control panel 205-*a* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The state module 305 may adjust the security state of an automation system based at least in part on one or more inputs from sensors and/or users of the automation system. In some instances, the state module 305 may receive a request to set the automation system to a first state associated with at least one occupant being present in the residence. The state module 305 may automatically detect the presence of an occupant through the use of one or more sensors. For example, the state module 305 may detect motion within a home associated with a person, may detect a mobile device associated with a user in the home, may use sound detection such as human sounds (voices, coughing, laughing, footsteps, etc.), and the like to detect the presence of an occupant in the home. In some instances, the state module 305 may confirm the at least one occupant is present in the residence. For example, the state module 305 may request a confirmation response from a mobile device in the home. If no response is received, the state module 305 may not activate the setting. Alternatively, the state module 305 may use the control panel 205-*a* to send out a request to confirm the presence of an occupant in the residence.

The state activation module 310 may activate or deactivate one or more alerts. The activation or deactivation may be based at least in part on a state setting by the state module 305. For example, if a smart stay day setting is activated, the state activation module 310 may activate or deactivate set alarms. The alarms may be default settings or may be user-based settings. The state activation module 310 may activate driveway or entry way alerts. For example, the state activation module 310 may activate an alert to an occupant when a vehicle enters the driveway of a residence. This may put the occupant on notice that a person is about to approach the home. If the occupant is expecting the arrival of a vehicle, this may alert the occupant that the vehicle has arrived. If the occupant is not expecting the arrival of a vehicle, the occupant may be alerted and may take one or more actions based on the alert. For example, the occupant may silence a doorbell, ensure the front door is locked if the vehicle is not known to the occupant, and the like. The occupant may request additional information on the vehicle, such as a license plate, make, model, identifiers on the side of the vehicle, occupants detected within the vehicle or exiting the vehicle. The alert may transmit images of the vehicle to the occupant and/or another user of the automation system.

In alternative embodiments, the state activation module 310 may track entryways to a home. For example, the state activation module 310 may track windows, doors, garage doors, and the like. The state activation module 310 may send an alert to the occupant and/or another user whenever a person is detected approaching any entryway to the home. If the person is approaching a front doorway, the occupant may receive a notification that a person is proximate the entry and, in some instances, may provide a visual of the person proximate the entry to the occupant. The occupant may have the ability to review the image and silence a doorbell. For example, if the person approaching the doorway is a mailman, the occupant may not need to go to the door and may silence a doorbell. Alternatively, the state activation module 310 may determine an identity of the person proximate the entry to the residence and may route the doorbell notification to a user of the automation system associated with the person. For example, the residence may have a smart doorbell which may interact with the person proximate the entry. By identifying and smartly routing doorbell notifications, the occupant may be prevented from answering the door or dealing with an otherwise unknown entity. In some embodiments, the state activation module 310 may activate one or more external lights based at least in part on time of day and the state of the automation system. For example, the state activation module 310 may activate external lights to increase security around a home if a single occupant is in the house. In alternative embodiments, the state activation module 310 may activate motion sensors associated with the lights such that the lights may only illuminate when the motion sensors are activated.

In another embodiment, the state activation module 310 may be equipped with behavioral information associated with the occupant of the home. The state activation module 310 may receive information providing a positive identity of a specific user which may be linked to a behavioral pattern. The state activation module 310 may use the behavioral patterns of the specific user to detect when to activate and deactivate select alarms and/or alert thresholds. For example, the state activation module 310 may deactivate an entry alarm setting when user typically picks up the mail.

Alternatively, the state activation module 310 may deactivate an alarm when the user performs a daily routine, such as morning jog, or dog walking, and may anticipate the return of the user upon typical time frame of completion of said activity. In another embodiment, the behavioral patterns may not be linked to a specific person, but may be generic patterns linked to the household in general. For example, the state activation module 310 may predict when an occupant may awaken after a night's rest and may deactivate one or more motion detectors may on the presumption of the occupant's predicated behaviors.

The alert module 315 may adjust one or more existing alerts to align with a smart stay day module 215. For example, the alert module 315 may dynamically adjust a doorbell parameter based at least in part on the state of the automation system, e.g. the smart day stay state. The automation system may detect a location of an occupant of the residence to adjust the doorbell settings. For example, if a person is showering, sleeping, or otherwise preoccupied, the automation system may silence the doorbell or, in some instances, route the doorbell notification to a user of the automation system. If a child is sleeping or if an adult is working in the back yard, the doorbell notification may be silently sent to a mobile device associated with the adult to ensure the adult is alerted to a person proximate an entryway.

The alert module 315 may detect when barriers to an entry to a residence are opened. The alert module 315 may receive information to determine if the barriers are opened from an interior or exterior of the residence. The alert module 315 may send an alert to the occupant of the opening and the proximity for opening (i.e. opened from the interior or exterior of the residence). In some instances, the alert module 315 may request confirmation that the occupant is safe and/or that the occupant effectuated the opening of the barrier. If the occupant does not know the source of the change in the barrier open status, the occupant may respond as such and the alert module 315 may activate an alarm state. In some embodiments, if a unique code or other key is used to enter the residence and effectuates the opening of a barrier, the alert module 315 may not activate an alarm state but may inform the occupant of a user's arrival to the residence after linking the unique code to a user profile.

In some instances, the alert module 315 may deactivate certain alarm settings and activate new settings. For example, the alert module 315 may deactivate one or more motion sensors proximate an interior of the residence. Deactivating the motion sensors may allow the occupant to move freely through the home without the potential repercussions of activating an alarm state. In some instances, if a minor or other non-supervisory person is in the residence, an administrator or adult user of the automation system may activate one or more motion sensors proximate sensitive areas of a home. Sensitive areas of a home may include a parent's bedroom, a liquor cabinet, a home office, a storage location for firearms, and the like.

In other embodiments, the alert module 315 may determine two or more occupants are in the home. For example, a parent and a child may be at home in a residence. The alert module 315 may then activate an occupant exit alert. The alert module 315 may identify when at least one occupant has exited the residence. This may be the adult taking the trash out or the child exiting the rear door to the backyard. The alert module 315 may deactivate an alert when the at least one occupant reenters the residence within a predetermined time threshold. If the occupant does not reenter, the occupant, or supervisory parent, may receive a notification of the exiting and may request an action response. For example, both the parent and child may have exited the home and the parent may have forgotten to set an alarm state of the automation system. Or the parent may have been unaware that the child exited and may request a child location service to be activated or if any additional external motion has been detected.

Figure 4:
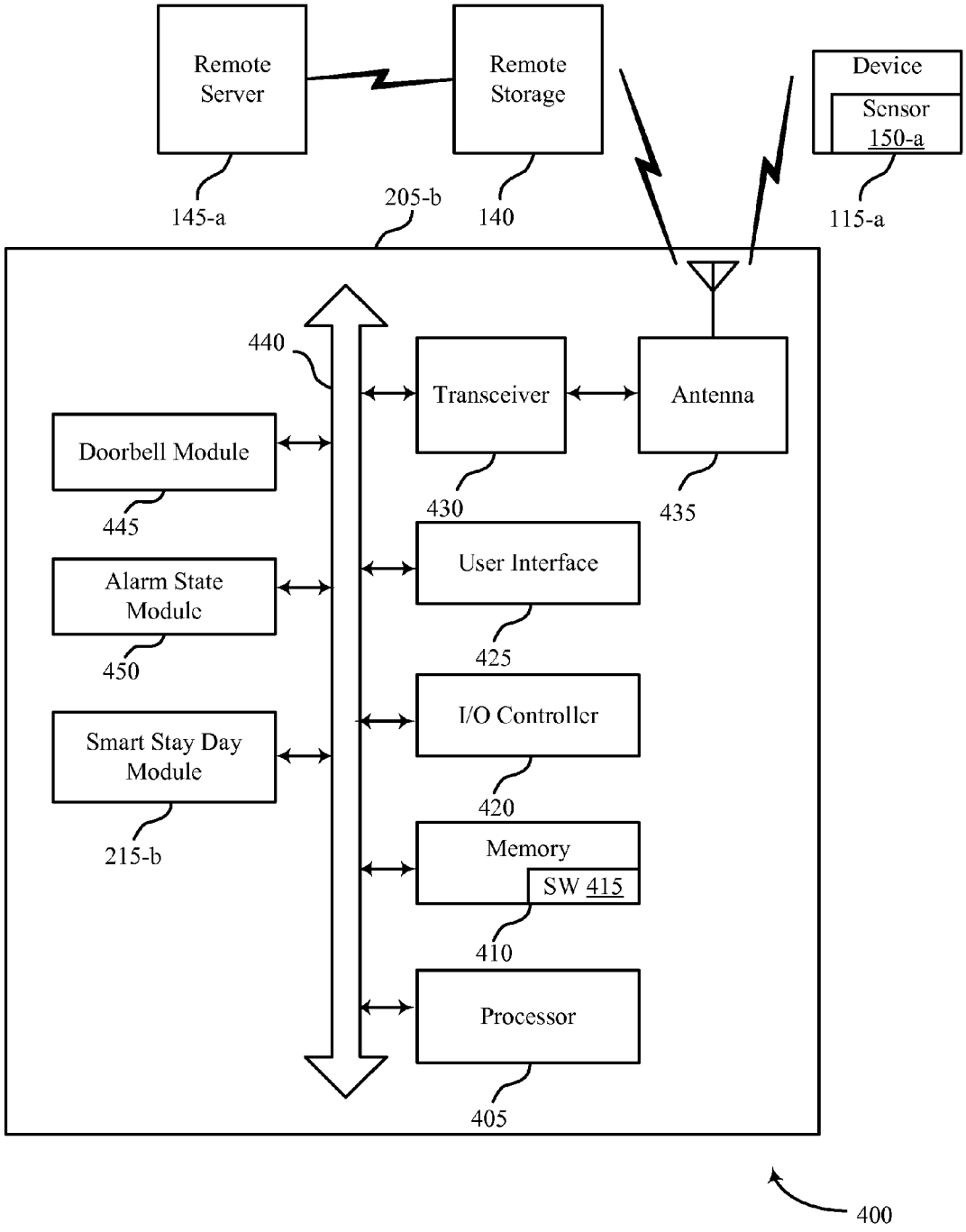
FIG. 4 shows a block diagram relating to a security and/or an automation system, in accordance with various aspects of this disclosure.

FIG. 4 shows a system 400 for use in smart stay day systems, in accordance with various examples. System 400 may include a control panel 205-*b*, which may be an example of the control panels 105 of FIG. 1. Control panel 205-*b* may also be an example of one or more aspects of control panels 205 and/or 205-*a* of FIGS. 2 and 3.

Control panel 205-*b* may include doorbell module 445. Control panel 205-*b* may also include alarm state module 450. Control panel 205-*b* may also include smart stay day module 215-*b*, which may be an example of smart stay day module 215 described with reference to FIGS. 2 and/or 3. In some embodiments, the terms a control panel and a control device are used synonymously.

Control panel 205-*b* may also include components for bi-directional voice and data communications including components for transmitting communications and components for receiving communications. For example, control panel 205-*b* may communicate bi-directionally with one or more of device 115-*a*, one or more sensors 150-*a*, remote storage 140, and/or remote server 145-*a*, which may be an example of the remote server of FIG. 1. This bi-directional communication may be direct (e.g., control panel 205-*b* communicating directly with remote storage 140) or indirect (e.g., control panel 205-*b* communicating indirectly with remote server 145-*a* through remote storage 140).

The doorbell module 445 may detect one or more people proximate an entry to the residence based at least in part on one or more detection parameters. For example, the doorbell module 445 may be linked with at least a camera sensor and/or motion sensor proximate an entry to the residence. The combination of the sensors may detect when human motion is present proximate the entry to allow for a warning to be issued to an occupant of the home.

The alarm state module 450 may activate one or more alarm states based at least in part on one or more alarm parameters. The alarm state module 450 may respond to one or more alerts to an occupant prior to activating a security and/or other alarm associated with the automation system. The alarm state module 450 may activate an alarm to other users of the automation system if the alarm status is contained and requires immediate familial attention. Alternatively and/or additionally, if an emergency status has been detected, the alarm state may request aid from first responders. In other embodiments, the alarm state module 450 may issue a visual and/or audible alarm emanating from the residence in response to an emergency state. The emergency state may include a fire, carbon monoxide, an intruder, a potential intruder, and the like.

Control panel 205-*b* may also include a processor module 405, and memory 410 (including software/firmware code (SW) 415), an input/output controller module 420, a user interface module 425, a transceiver module 430, and one or more antennas 435 each of which may communicate—directly or indirectly—with one another (e.g., via one or more buses 440). The transceiver module 430 may communicate bi-directionally—via the one or more antennas 435, wired links, and/or wireless links—with one or more networks or remote devices as described above. For example, the transceiver module 430 may communicate bi-directionally with one or more of device 115-*a*, remote storage 140, and/or remote server 145-*a*. The transceiver module 430 may include a modem to modulate the packets and provide the modulated packets to the one or more antennas 435 for transmission, and to demodulate packets received from the one or more antenna 435. While a control panel or a control device (e.g., 205-*b*) may include a single antenna 435, the control panel or the control device may also have multiple antennas 435 capable of concurrently transmitting or receiving multiple wired and/or wireless transmissions. In some embodiments, one element of control panel 205-*b* (e.g., one or more antennas 435, transceiver module 430, etc.) may provide a direct connection to a remote server 145-*a* via a direct network link to the Internet via a POP (point of presence). In some embodiments, one element of control panel 205-*b* (e.g., one or more antennas 435, transceiver module 430, etc.) may provide a connection using wireless techniques, including digital cellular telephone connection, Cellular Digital Packet Data (CDPD) connection, digital satellite data connection, and/or another connection.

The signals associated with system 400 may include wireless communication signals such as radio frequency, electromagnetics, local area network (LAN), wide area network (WAN), virtual private network (VPN), wireless network (using 802.11, for example), 345 MHz, Z-WAVE®, cellular network (using 3G and/or LTE, for example), and/or other signals. The one or more antennas 435 and/or transceiver module 430 may include or be related to, but are not limited to, WWAN (GSM, CDMA, and WCDMA), WLAN (including BLUETOOTH® and Wi-Fi), WMAN (WiMAX), antennas for mobile communications, antennas for Wireless Personal Area Network (WPAN) applications (including RFID and UWB). In some embodiments, each antenna 435 may receive signals or information specific and/or exclusive to itself. In other embodiments, each antenna 435 may receive signals or information not specific or exclusive to itself.

In some embodiments, one or more sensors 150-*a* (e.g., motion, proximity, smoke, light, glass break, door, window, carbon monoxide, and/or another sensor) may connect to some element of system 400 via a network using one or more wired and/or wireless connections.

In some embodiments, the user interface module 425 may include an audio device, such as an external speaker system, an external display device such as a display screen, and/or an input device (e.g., remote control device interfaced with the user interface module 425 directly and/or through I/O controller module 420).

One or more buses 440 may allow data communication between one or more elements of control panel 205-*b* (e.g., processor module 405, memory 410, I/O controller module 420, user interface module 425, etc.).

The memory 410 may include random access memory (RAM), read only memory (ROM), flash RAM, and/or other types. The memory 410 may store computer-readable, computer-executable software/firmware code 415 including instructions that, when executed, cause the processor module 405 to perform various functions described in this disclosure (e.g., respond to specific status settings of the automation system, alter one or more alert settings, etc.). Alternatively, the software/firmware code 415 may not be directly executable by the processor module 405 but may cause a computer (e.g., when compiled and executed) to perform functions described herein. Alternatively, the computer-readable, computer-executable software/firmware code 415 may not be directly executable by the processor module 405 but may be configured to cause a computer (e.g., when compiled and executed) to perform functions described herein. The processor module 405 may include an intelligent hardware device, e.g., a central processing unit (CPU), a microcontroller, an application-specific integrated circuit (ASIC), etc.

In some embodiments, the memory 410 can contain, among other things, the Basic Input-Output system (BIOS) which may control basic hardware and/or software operation such as the interaction with peripheral components or devices. For example, the smart stay day module 215-*b* to implement the present systems and methods may be stored within the system memory 410. Applications resident with system 400 are generally stored on and accessed via a non-transitory computer readable medium, such as a hard disk drive or other storage medium. Additionally, applications can be in the form of electronic signals modulated in accordance with the application and data communication technology when accessed via a network interface (e.g., transceiver module 430, one or more antennas 435, etc.).

Many other devices and/or subsystems may be connected to one or may be included as one or more elements of system 400 (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 4 need not be present to practice the present systems and methods. The devices and subsystems can be interconnected in different ways from that shown in FIG. 4. In some embodiments, an aspect of some operation of a system, such as that shown in FIG. 4, may be readily known in the art and are not discussed in detail in this application. Code to implement the present disclosure can be stored in a non-transitory computer-readable medium such as one or more of system memory 410 or other memory. The operating system provided on I/O controller module 420 may be iOS®, ANDROID®, MS-DOS®, MS-WINDOWS®, OS/2®, UNIX®, LINUX®, or another known operating system.

The transceiver module 430 may include a modem configured to modulate the packets and provide the modulated packets to the antennas 435 for transmission and/or to demodulate packets received from the antennas 435. While the control panel or control device (e.g., 205-*b*) may include a single antenna 435, the control panel or control device (e.g., 205-*b*) may have multiple antennas 435 capable of concurrently transmitting and/or receiving multiple wireless transmissions.

The control panel 205-*b* may include a smart stay day module 215-*b*, which may perform the functions described above for the smart stay day module 215 of control panel 205 of FIGS. 2 and 3.

Figure 5:
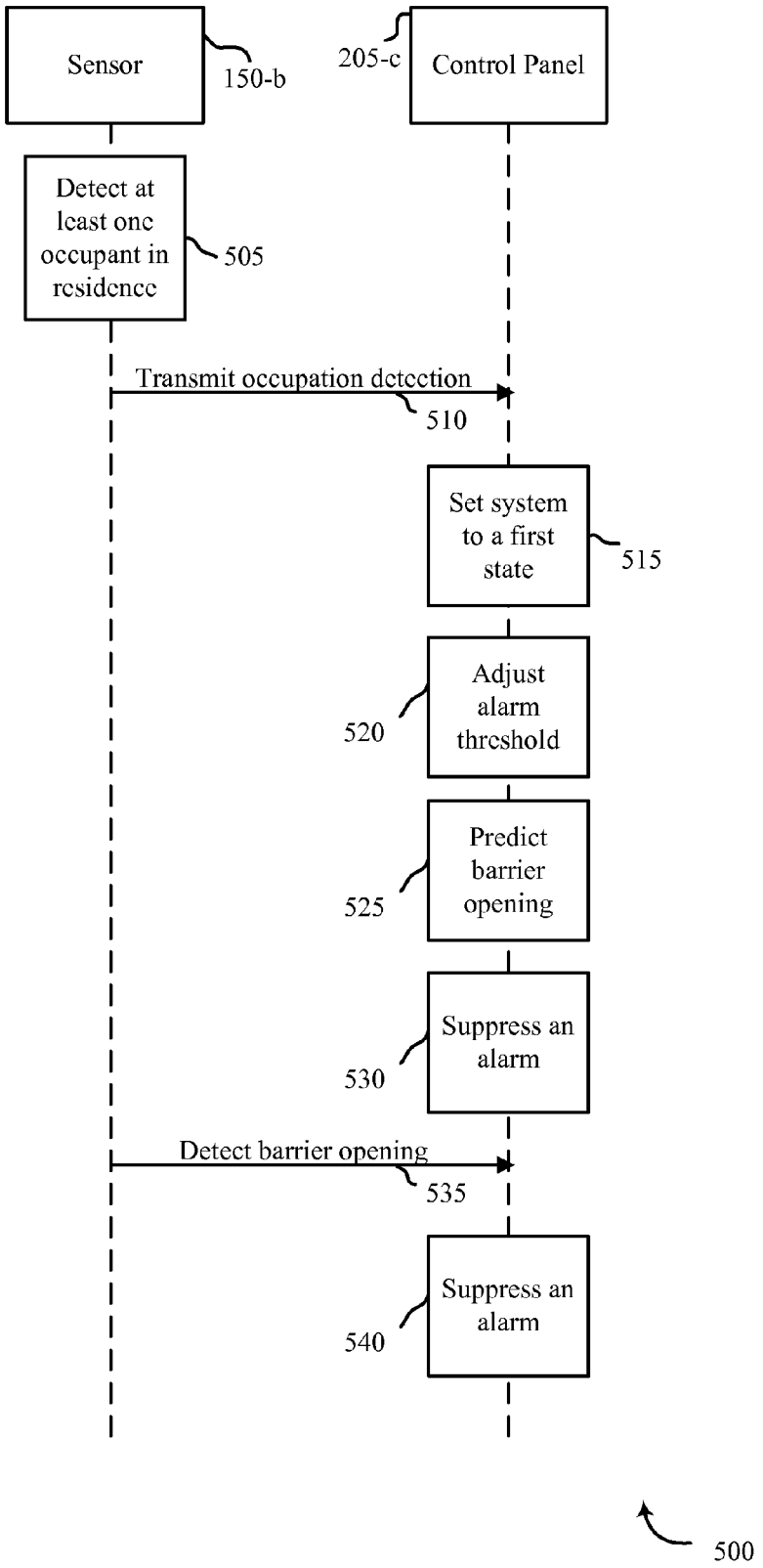
FIG. 5 shows a swim diagram relating to a security and/or an automation system, in accordance with various aspects of this disclosure.

FIG. 5 shows a flow diagram for use in smart stay day systems, in accordance with various examples. The system 500 may include a control panel 205-*c*, which may be an example of the control panels 105 of FIG. 1. Control panel 205-*b* may also be an example of one or more aspects of control panels 205 and/or 205-*a* of FIGS. 2 and 3. The system 500 may additionally include a sensor 150-*b*, which may be an example of the sensor 150 in FIGS. 1 and/or 4.

The sensor 150-*b* may detect at least one occupant in the residence 505. The sensor 150-*b* may transmit the occupancy information 510 to the control panel 205-*c*. The control panel 205-*c* may analyze the information and may set the automation system to a first state 515 associated with the occupancy detection. The control panel 205-*c* may dynamically adjust an alarm threshold 520. The alarm threshold may be associated with a barrier to an entry to a residence. The control panel 205-*c* may predict when a person is about to open the barrier 525. The control panel 205-*c* may suppress an alarm 530 by predicting the occupant opened the barrier based at least in part on habitual patterns of the occupant. Alternatively and/or additionally, the sensor 150-*b* may be proximate the barrier to the entry and may detect when the barrier is opened from inside the home 535. The control panel 205-*c* may suppress an alarm 540 due to the fact that door was opened from the inside.

Figure 6:
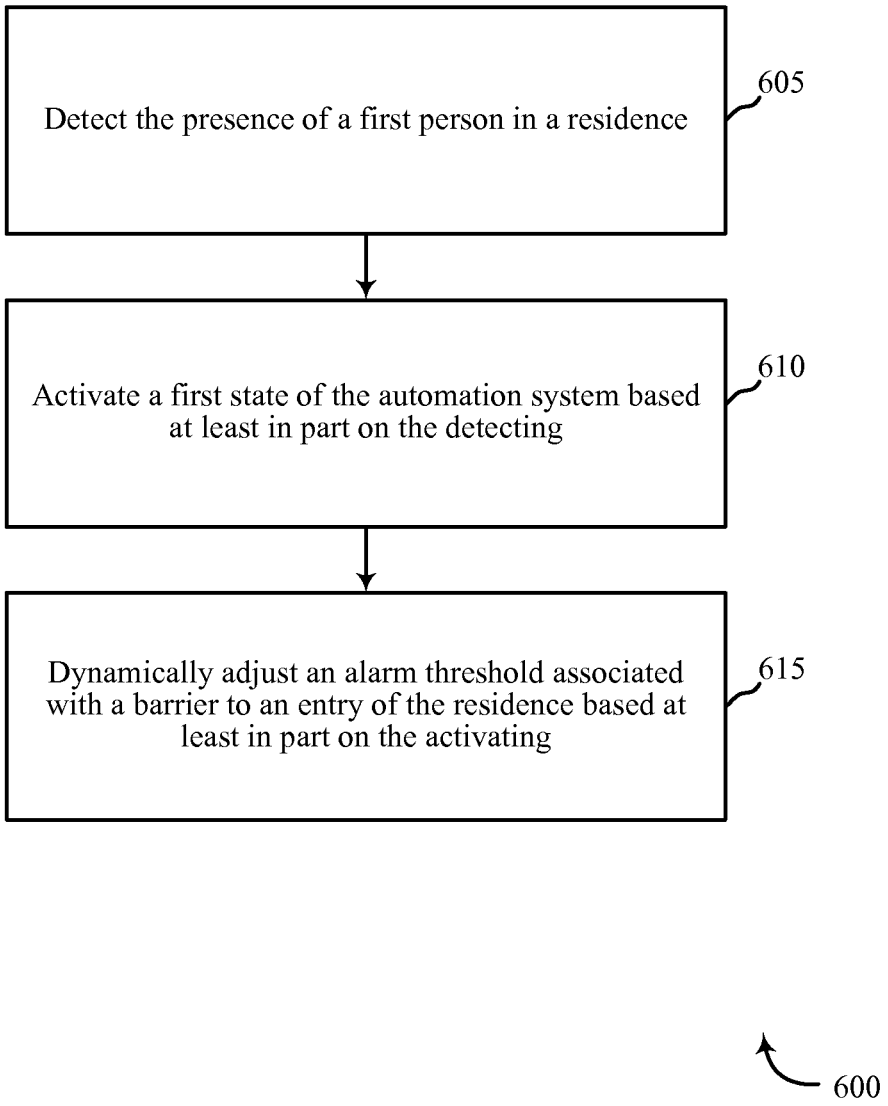
FIG. 6 is a flow chart illustrating an example of a method relating to a security and/or an automation system, in accordance with various aspects of this disclosure.

FIG. 6 is a flow chart illustrating an example of a method 600 for smart stay day systems, in accordance with various aspects of the present disclosure. For clarity, the method 600 is described below with reference to aspects of one or more of the smart stay day module 215 described with reference to FIGS. 2-4, and/or aspects of one or more of the doorbell module 445 and/or the alarm state module 450 described with reference to FIG. 4. In some examples, a control panel and/or sensor may execute one or more sets of codes to control the functional elements of the alarm state module 450 to perform the functions described below. Additionally or alternatively, the control panel may perform one or more of the functions described below using special-purpose hardware.

At block 605, the method 600 may include detecting the presence of a first person in a residence. Through the use of use of one or more sensors the presence of a first person in a residence may be confirmed by the first person or by another user of the automation system. The sensors may detect motion within a home associated with a person, may detect a mobile device associated with a user in the home, may use sound detection such as human sounds (voices, coughing, laughing, footsteps, etc.), and the like to detect the presence of an occupant in the home. The confirmation may additionally be queued by the control panel which may confirm a person in the home.

At block 610, the method 600 may include activating a first state of the automation system based at least in part on the detecting of the presence of a first person in a residence. For example, upon detecting the presence of a first person in a residence the automation system may activate the first state and confirm a person is present in the house. The first state may be an alarm that may activate or deactivate based on default settings or user based setting. The first state may activate an alert to an occupant when a vehicle enters the driveway of a residence. This may put the occupant on notice that a first person is about to approach the home. If the occupant is expecting the arrival of a vehicle, this may alert the occupant that the vehicle has arrived. If the occupant is not expecting the arrival of a vehicle, the occupant may be alerted and may take one or more actions based on the alert. For example, the occupant may silence a doorbell, ensure the front door is locked if the vehicle is not known to the occupant, and the like. The occupant may request additional information on the vehicle, such as a license plate, make, model, identifiers on the side of the vehicle, occupants detected within the vehicle or exiting the vehicle. The alert may transmit images of the vehicle to the occupant and/or another user of the automation system.

The operation(s) at block 605, 610 may be performed using the state module 305 and/or the alert module 315 described with reference to FIG. 3.

At block 615, the method 600 may include dynamically adjusting an alarm threshold associated with a barrier to an entry of the residence based at least in part on the activating. The alarm threshold may be adjusted based on a first person in the residence to reduce and/or attempt to eliminate false alarms. The alarm threshold may include altering current alarm settings or adding new settings as discussed previously to allow for a secure status of the residence without jeopardizing the cause of an overt number of alarms. At block 615, the method 600 may, for example, dynamically adjust a doorbell parameter based at least in part on the state of the automation system, e.g. the smart day stay state. The automation system may detect a location of an occupant of the residence to adjust the doorbell settings. For example, if a person is showering, sleeping, or otherwise preoccupied, the automation system may silence the doorbell or, in some instances, route the doorbell notification to a user of the automation system. If a child is sleeping or if an adult is working in the back yard, the doorbell notification may be silently sent to a mobile device associated with the adult to ensure the adult is alerted to a person proximate an entryway.

In some instances, at block 615, the method 600 may deactivate certain alarm settings and activate new settings. For example, the method 600 may deactivate one or more motion sensors proximate an interior of the residence. Deactivating the motion sensors may allow the occupant to move freely through the home without the potential repercussions of activating an alarm state. In some instances, if a minor or other non-supervisory person is in the residence, an administrator or adult user of the automation system may activate one or more motion sensors proximate sensitive areas of a home. Sensitive areas of a home may include a parent's bedroom, a liquor cabinet, a home office, a storage location for firearms, and the like.

The operation(s) at block 615 may be performed using the state activation module 310 and/or the alert module 315 described with reference to FIG. 3.

Thus, the method 600 may provide for smart stay day systems relating to automation/security systems. It should be noted that the method 600 is just one implementation and that the operations of the method 600 may be rearranged or otherwise modified such that other implementations are possible.

Figure 7:
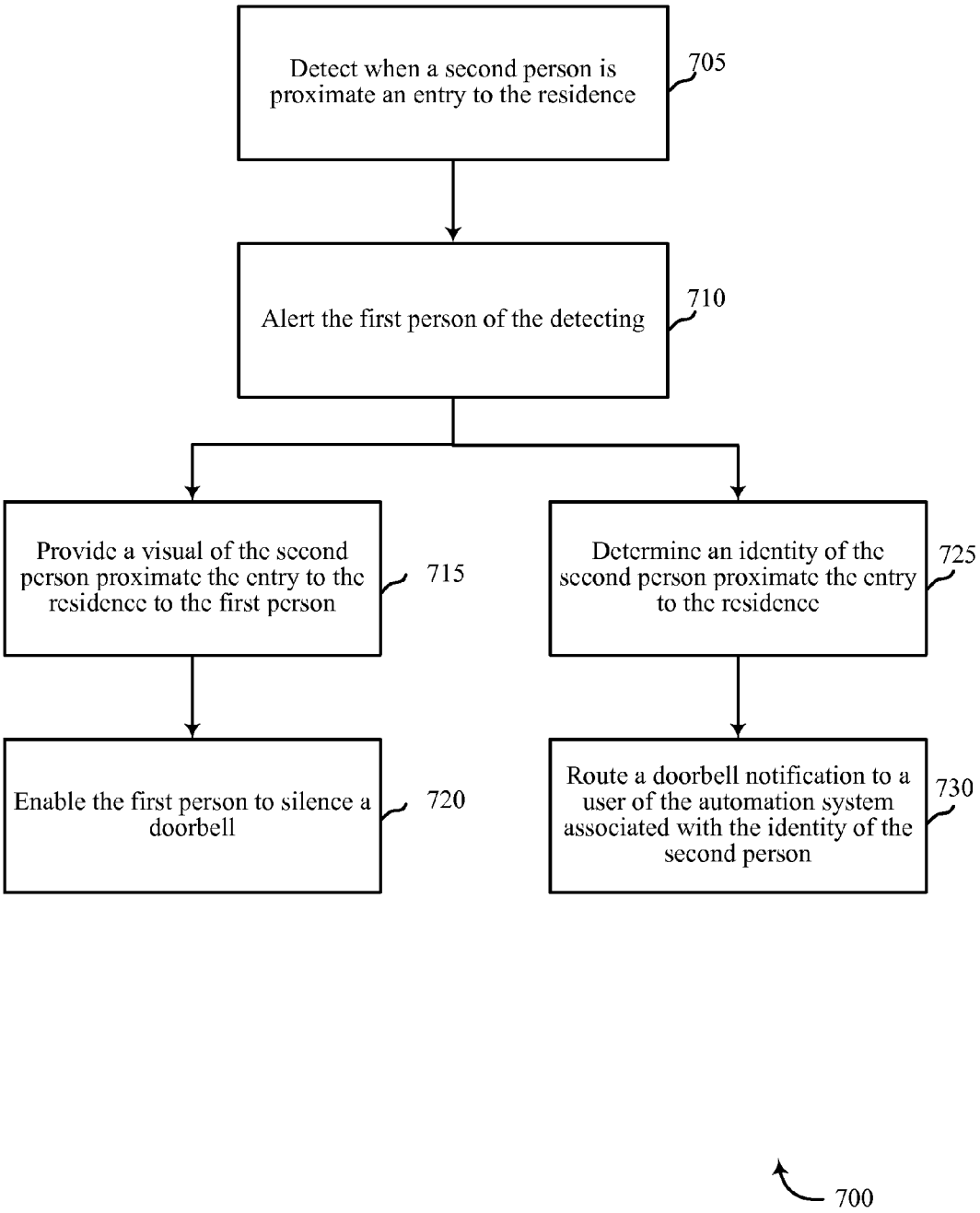
FIG. 7 is a flow chart illustrating an example of a method relating to a security and/or an automation system, in accordance with various aspects of this disclosure.

FIG. 7 is a flow chart illustrating an example of a method 700 for smart stay day systems, in accordance with various aspects of the present disclosure. For clarity, the method 700 is described below with reference to aspects of one or more of the smart stay day module 215 described with reference to FIGS. 2-4, and/or aspects of one or more of the doorbell module 445 and/or the alarm state module 450 described with reference to FIG. 4. In some examples, a control panel and/or sensor may execute one or more sets of codes to control the functional elements of the alarm state module 450 to perform the functions described below. Additionally or alternatively, the control panel may perform one or more of the functions described below using special-purpose hardware.

At block 705, the method 700 may include detecting when a second person is proximate an entry to the residence. A doorbell camera and/or motion sensor may be proximate an entry to the residence and may determine when a second person is approaching the entry way. To avoid causing the first person undue alarm, the method 700, at block 710, may alert the first person of the detecting. This may be in the form of a text message to a user's device, an announcement over an audio system in the residence, an alert to the control panel, or the like.

The operation(s) at blocks 705, 710 may be performed using the state activation module 310 and/or the doorbell module 445 described with reference to FIG. 3.

At block 715, if the second person approaching the door is unidentifiable, the method 700 may include providing a visual of the second person proximate the entry to the first person. The visual may provide the first person safety and security of the first person. For example, if the first person is uncomfortable answering the door, the first person does not need to approach the door to determine who is at the door. Likewise, if the first person is preoccupied, the first person can decide not to answer the door because the second person does not require attention. In some instances, at block 720, the method 700 may include enabling the first person to silence a doorbell. This may further aid in the security and serenity of the first person in the home. The first person may be napping, bathing, attempting to put a child to sleep, or the like. The doorbell may be unnecessary if the first person is not going to answer the door and may allow the first person to continue on with their current task unperturbed by a doorbell chime.

If the second person is identifiable, at block 725, the method 700 may include determining an identity of the second person proximate the entry to the residence. The automation system may have a database of frequent guests to the residence. The automaton system may use features such as facial recognition, voice recognition, and other biometric features to identify the second person. In other embodiments, a device proximate the entry may allow a guest to input information which may self-identify the second person. Once an identity is known, at block 730, the method 700 may include routing the doorbell notification to a user of the automation system associated with the identity of the second person. In some instances, the identity of a second person may be linked to a specific user. In other embodiments, the second person may use the device proximate the entry to request a specific resident which may enable the method 700 to accurately route the doorbell notification to the correct user. This feature may enable the occupant to continue on their day without the need to interface between a guest and a user.

The operation(s) at blocks 715,720, 725, 730 may be performed using the alert module 315 and/or the doorbell module 445 described with reference to FIG. 3.

Thus, the method 700 may provide for smart stay day systems relating to automation/security systems. It should be noted that the method 700 is just one implementation and that the operations of the method 700 may be rearranged or otherwise modified such that other implementations are possible.

Figure 8:
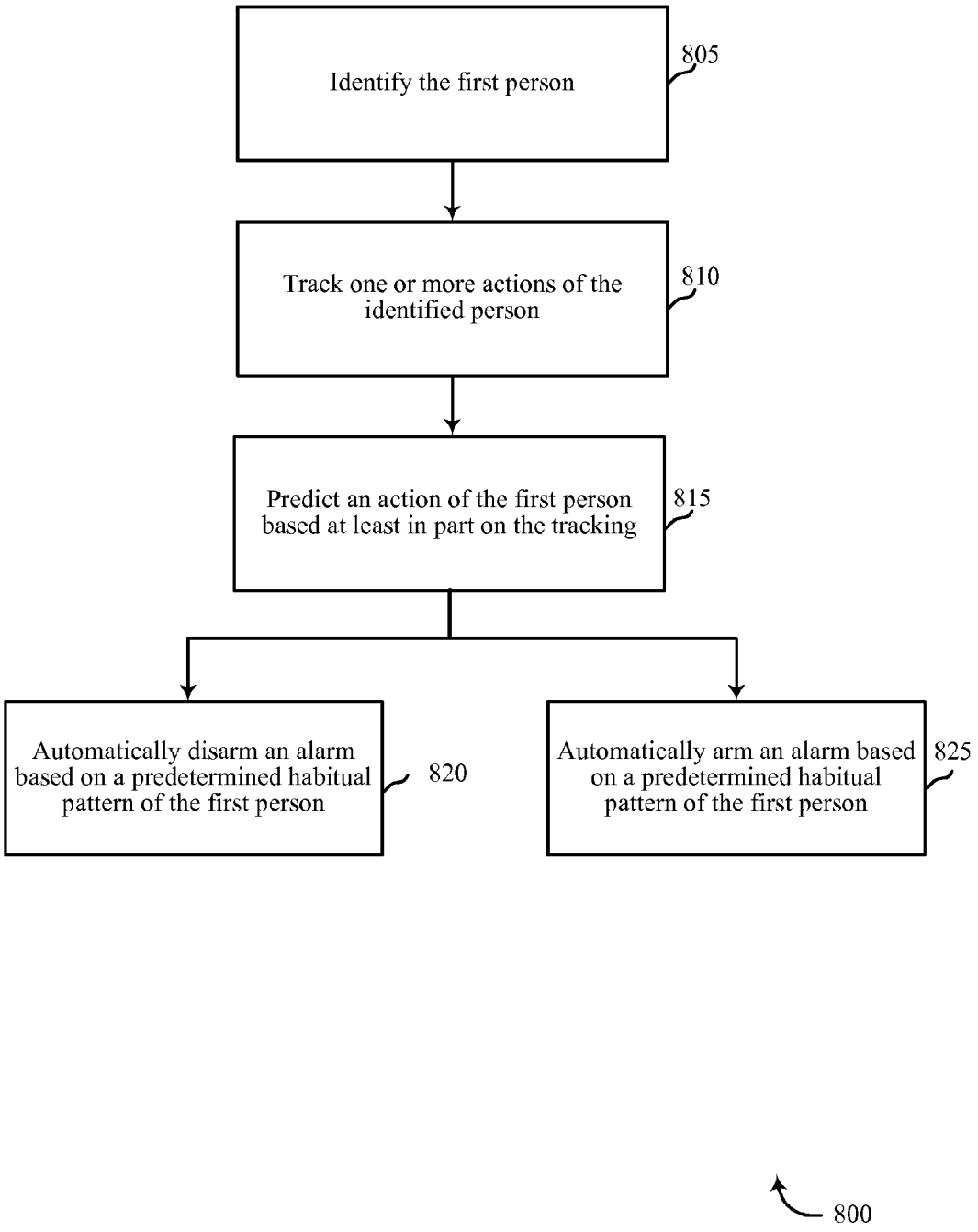
FIG. 8 is a flow chart illustrating an example of a method relating to a security and/or an automation system, in accordance with various aspects of this disclosure.

FIG. 8 is a flow chart illustrating an example of a method 800 for smart stay day systems, in accordance with various aspects of the present disclosure. For clarity, the method 800 is described below with reference to aspects of one or more of the smart stay day module 215 described with reference to FIGS. 2-4, and/or aspects of one or more of the doorbell module 445 and/or the alarm state module 450 described with reference to FIG. 4. In some examples, a control panel and/or sensor may execute one or more sets of codes to control the functional elements of the alarm state module 450 to perform the functions described below. Additionally or alternatively, the control panel may perform one or more of the functions described below using special-purpose hardware.

At block 805, the method 800 may include identifying the first person. Cameras and/or one or more sensors may be located throughout a residence and may determine the identity of a first person. The automation system may have a database of frequent guests to the residence. The automation system may use features such as facial recognition, voice recognition, and other biometric features to identify the first person. In other embodiments, a device may allow a guest to input information which may self-identify the first person.

At block 810, the method 800 may include tracking one or more actions of the first person. Using cameras and/or one or more sensors located throughout a residency, the actions of a first person may be tracked.

At block 815, the method 800 may also include predicting an action of the first person based at least in part on the tracking. Through the use of cameras and/or one or more sensors located throughout a residency, the actions of a first person may be predicted. The prediction of actions may be based on the current action of a first person, the habitual pattern of the first person, the direction of movement of the first person, and the like to predict the action of a first person.

At block 820, the method 800 may include automatically disarming an alarm based on a predetermined habitual pattern of the first person. Once an action is determined, at block 820, the method 800 may include automatically disarming an alarm to prevent a first person from triggering a false alarm, which if triggered may cause the user additional cost and trouble. For example, if the first person wants to enter a room in a home, the method 800 may disarm the room the first person enters. In another embodiment, if a first person has received administration permission, they may be able to access areas of a residence that would otherwise be closed off to guests (e.g., gun safe, home office, etc.).

If the first person is identifiable and/or unidentifiable, at block 825, the method 800 may include automatically arming an alarm based on a predetermined habitual pattern of the first person. Once an action is determined, at block 825, the method 800 may include automatically arming an alarm to prevent a first person from accessing secure locations in a residence. For example, if the first person wants to exit a room in a home, the smart stay day module 215 may arm the room the first person exits. In another embodiment, if a first person has not received administration permission, they may be unable to access areas of a residence that would otherwise be available to those who have received permission (e.g., gun safe, home office, etc.).

Thus, the method 800 may provide for smart stay day systems relating to automation/security systems. It should be noted that the method 800 is just one implementation and that the operations of the method 800 may be rearranged or otherwise modified such that other implementations are possible.

In some examples, aspects from two or more of the methods 600, 700, 800 may be combined and/or separated. It should be noted that the methods 600, 700, 800 are just example implementations, and that the operations of the methods 600, 700, 800 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk, and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for security and/or automation systems, comprising: detecting, by a processor, a presence of a first person in a residence; activating, by the processor, a first state of the automation system based at least in part on the detecting; and dynamically adjusting, by the processor, an alarm threshold associated with a barrier to an entry of the residence based at least in part on the activating, wherein dynamically adjusting the alarm threshold comprises: sensing when the barrier to the entry of the residence has been opened from an interior of the residence; and alerting the first person of the sensing, and wherein dynamically adjusting the alarm threshold further comprises: identifying when the first person has exited the residence; and deactivating an alert a first alarm within a first portion of the residence and activating a second alarm within a second portion of the residence when the first person reenters the residence within a predetermined time threshold.

2. The method of claim 1, further comprising:

identifying the first person;

tracking one or more actions of the identified first person; and predicting an action of the first person based at least in part on the tracking.

3. The method of claim 1, wherein dynamically adjusting the alarm threshold further comprises:

detecting when the barrier to the entry to the residence is opened from an exterior of the residence; and alerting the first person of the detecting.

4. The method of claim 1, further comprising:

automatically disarming the first alarm based on a predetermined habitual pattern of the first person.

5. The method of claim 1, wherein dynamically adjusting the alarm threshold further comprises:

dynamically adjusting a doorbell parameter.

6. The method of claim 1, further comprising:

detecting when a second person is proximate the entry to the residence; and alerting the first person of the detecting.

7. The method of claim 6, further comprising:

providing a visual of the second person proximate the entry to the residence to the first person; and enabling the first person to silence a doorbell.

8. The method of claim 6, further comprising:

determining an identity of the second person proximate the entry to the residence; and routing a doorbell notification to a user of the automation system associated with the identity of the second person.

9. The method of claim 1, wherein dynamically adjusting the alarm threshold further comprises:

deactivating one or more motion sensors proximate an interior of the residence.

10. The method of claim 1, further comprising:

activating one or more external lights to the residence based at least in part on time of day and occupancy.

11. The method of claim 1, further comprising:

identifying when a vehicle enters a driveway of the residence;

alerting the first person of the vehicle.

12. An apparatus for security and/or automation systems, comprising:

a processor;

memory in electronic communication with the processor; and instructions stored in the memory, the instructions being executable by the processor to:

detect a presence of a first person in a residence;

activate a first state of the automation system based at least in part on the detecting; and dynamically adjust an alarm threshold associated with a barrier to an entry of the residence based at least in part on the activating, wherein the instructions to dynamically adjust the alarm threshold are exectuable by the processor to:

sense when the barrier to the entry of the residence has been opened from an interior of the residence; and alert the first person of the sensing, and wherein the instruction to dynamically adjust the alarm threshold are further executable by the processor to:

identify when the first person has exited the residence; and deactivating a first alarm within a first portion of the residence and activating a second alarm within a second portion of the residence when the first person reenters the residence within a predetermined time threshold.

13. The apparatus of claim 12, wherein the instructions are further executable by the processor to:

identify the first person;

track one or more actions of the identified first person; and predict an action of the first person based at least in part on the tracking.

14. The apparatus of claim 12, wherein the instructions to dynamically adjust the alarm threshold are further executable by the processor to:

automatically disarm the first alarm based on a predetermined habitual pattern of the first person.

15. The apparatus of claim 12, wherein the instructions to dynamically adjust the alarm threshold are further executable by the processor to:

dynamically adjust a doorbell parameter.

16. A non-transitory computer-readable medium storing computer-executable code, the code executable by a processor to:

detect a presence of a first person in a residence;

activate a first state of an automation system based at least in part on the detecting; and dynamically adjust an alarm threshold associated with a barrier to an entry of the residence based at least in part on the activating, wherein dynamically adjusting the alarm threshold comprises:

sensing when the barrier to the entry of the residence has been opened from an interior of the residence; and alerting the first person of the sensing;

and wherein dynamically adjusting the alarm threshold further comprises:

identifying when the first person has exited the residence; and deactivating a first alarm within a first portion of the residence and activating a second alarm within a second portion of the residence when the first person reenters the residence within a predetermined time threshold.

17. The non-transitory computer-readable medium of claim 16, wherein the code is further executable by the processor to:

identify the first person;

track one or more actions of the identified first person; and predict an action of the first person based at least in part on the tracking.

18. The non-transitory computer-readable medium of claim 16, wherein the code to dynamically adjust the alarm threshold is further executable by the processor to:

automatically disarm the first alarm based on a predetermined habitual pattern of the first person.

19. The non-transitory computer-readable medium of claim 16, wherein the code to dynamically adjust the alarm threshold is further executable by the processor to:

dynamically adjust a doorbell parameter.

* * * * *